United States Patent [19]

Lawler

[11] 4,202,585

[45] May 13, 1980

[54] PORTABLE STORAGE MODULES FOR FLOPPY DISKS AND THE LIKE

[75] Inventor: Cary R. Lawler, Broomfield, Colo.

[73] Assignee: The A-Team, Inc., Broomfield, Colo.

[21] Appl. No.: 925,940

[22] Filed: Jul. 19, 1978

[51] Int. Cl.[2] ..... A47B 81/06

[52] U.S. Cl. ..... 312/15; 312/18; 206/387; 211/40

[58] Field of Search ..... 312/15, 8–12, 312/18, 19; 211/40; 206/387

[56] References Cited

U.S. PATENT DOCUMENTS

| | | | |
|---|---|---|---|
| 1,014,929 | 1/1912 | Wood | 312/15 |
| 1,267,981 | 5/1918 | Crippen | 312/15 |
| 2,330,173 | 9/1943 | Gordon, Jr. et al. | 312/15 |
| 2,674,507 | 4/1954 | Cordova | 312/15 |
| 3,481,656 | 12/1969 | Landers | 312/18 |
| 3,612,233 | 10/1971 | Nagpal | 206/387 |
| 3,812,960 | 5/1974 | Falletta et al. | 206/387 |
| 3,969,007 | 7/1976 | Lowry | 206/387 |
| 4,026,615 | 5/1977 | Tazaki et al. | 312/12 |
| 4,121,877 | 10/1978 | Brown | 312/15 |

FOREIGN PATENT DOCUMENTS

| | | | |
|---|---|---|---|
| 180026 | 5/1922 | United Kingdom | 312/15 |

*Primary Examiner*—Victor N. Sakran
*Attorney, Agent, or Firm*—John E. Reilly

[57] ABSTRACT

A modular storage container for flexible recording disks is made up of a plurality of lightweight, flat rectangular panels which are interconnected to form a corresponding number of storage compartments. The outside panels have handle grips to facilitate handling or transporting of the containers, and each storage compartment contains an actuating lever mechanism which through selective depression of an associated push rod having a tab located externally of the compartment, will cause a selected disk to be advanced from its storage location for removal and use. A series of tabs alternate in such a fashion as to allow the rods to be close together without touching one another; yet each tab may be depressed individually without interference from the other tabs.

14 Claims, 7 Drawing Figures

PORTABLE STORAGE MODULES FOR FLOPPY DISKS AND THE LIKE

BACKGROUND OF THE INVENTION

The handling and storage of diskettes or so-called floppy disks has presented certain unique problems in terms of assuring protection of the disks when not in use, accurate indexing to facilitate retrieval of a selected disk, and ease of transportation or relocation of a number of disks from one site to another. As presently designed, the floppy disk consists of an 8" circular disk which is punched out of a polyester film coated with iron oxide. The disk rotates freely within a jacket made up of a plastic outer cover and liner, the liner material preventing damage to the diskette, and also minimizes data loss by imparting a cleaning action which will eliminate static charges. A dent, wrinkle, scratch or fingerprint on the diskette either from mishandling or improper storage can render the medium either partially or completely useless. Moreover manufacturers recommend that the diskettes not be stored flat or upon one another; also the diskettes are susceptible to damage from pressure or temperature changes.

The great number of diskettes utilized in larger data processing centers and widely dispersed geographic data gathering centers, makes imperative a storage system which is extremely compact and mobile so that the storage system will readily conform itself to fit within existing shelf space or merely to be placed on open counters or tables if desired. Moreover, it is highly desirable that a modular storage system be provided so that each container unit can be designed with a predetermined or selected number of storage compartments simply by combining together the desired number of modules; and further a series or group of container units can be compactly nested or stacked together so as to occupy a minimum of space. Still further it is desirable that the container units be so designed that the slotted compartments can either be positioned horizontally or vertically while permitting ready access for quick retrieval and replacement of desired diskettes.

Storage containers have been devised in the past for other types of articles such as phonograph records which are in the form of file cabinets having slotted compartments adapted to receive records, and ejector mechanism are associated with each compartment to selectively reject a record therefrom. Representative of such patents are U.S. Pat. Nos. 1,018,689 to Woods; 1,270,584 to Adams; 2,674,507 to Cordova; 1,360,680 to Pomeroy et al; and 2,330,173 to Gordon, Jr. et al. However, file cabinets of the type devised are not of modular construction, or of the type which will permit compact stacking or nesting together in different arrangements which will permit maximum utilization of space.

SUMMARY OF THE INVENTION

It is therefore an object of the present invention to provide for a novel and improved modular storage container for flexible recording mediums.

It is another object of the present invention to provide for a novel and improved portable, lightweight modular storage container having a series of storage compartments and cooperating actuator mechanisms to facilitate the storage and retrieval of recording information contained on floppy disks and the like.

It is a further object of the present invention to provide for a portable, modular storage container system in which a series of container units having a preselected number of storage compartments can be readily nested or stacked together in different desired configurations; and further wherein each individual container unit may be disposed in different positions while affording ready access for removal of a selected disk.

It is another object of the present invention to provide for a novel and improved portable, modular storage unit specifically adaptable for storage of floppy disks in a series of closely spaced storage compartments, each compartment provided with its own individual actuator mechanism and indexing means for selected retrieval of a disk from that compartment, and each unit provided with outside panels having conveniently located handles to facilitate movement of the units to different locations.

In accordance with a preferred embodiment of the present invention, a floppy disk storage container is made up of a plurality of generally flat, rectangular storage modules which are interconnected in closely spaced, juxtaposed relation to one another to define a corresponding series of storage cells into which floppy disks or diskettes may be placed. The outermost modules of each container unit are provided with handles which are aligned with one another and which form planar extensions of their respective modules. Each of the modules houses a spring-loaded ejector mechanism characterized by having a lever arm extending across the rear of the space to engage the inner edge of the diskette and a push rod which extends forwardly from engagement with the lever arm and terminates in a push tab which is located externally of the respective cell. A spring mechanism normally urges the lever to a retracted position permitting the diskette to remain in the cell, but when the push rod is depressed it will overcome the urging of the spring to cause the lever to advance the diskette through the slotted entrance of each cell for ready removal by the operator. Complementary ribs and recesses are formed on the external surfaces of the container in such a way as to permit nesting of the male or rib portion on one surface with a recessed portion on the surface of the next adjacent container. In addition, the ribbed portion provides a surface for any suitable type of indexing or coded numbering system for identification of the disk contained in the compartments of each unit.

The individual panels making up each module are provided with complementary ribs and recesses so that the ribbed portions on one surface of a panel will closely interfit with recesses on the surface of the next adjacent panel so as to accurately locate and align adjacent panels together to form a common cell therebetween with the necessary guides for the spring-loaded ejector mechanism.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
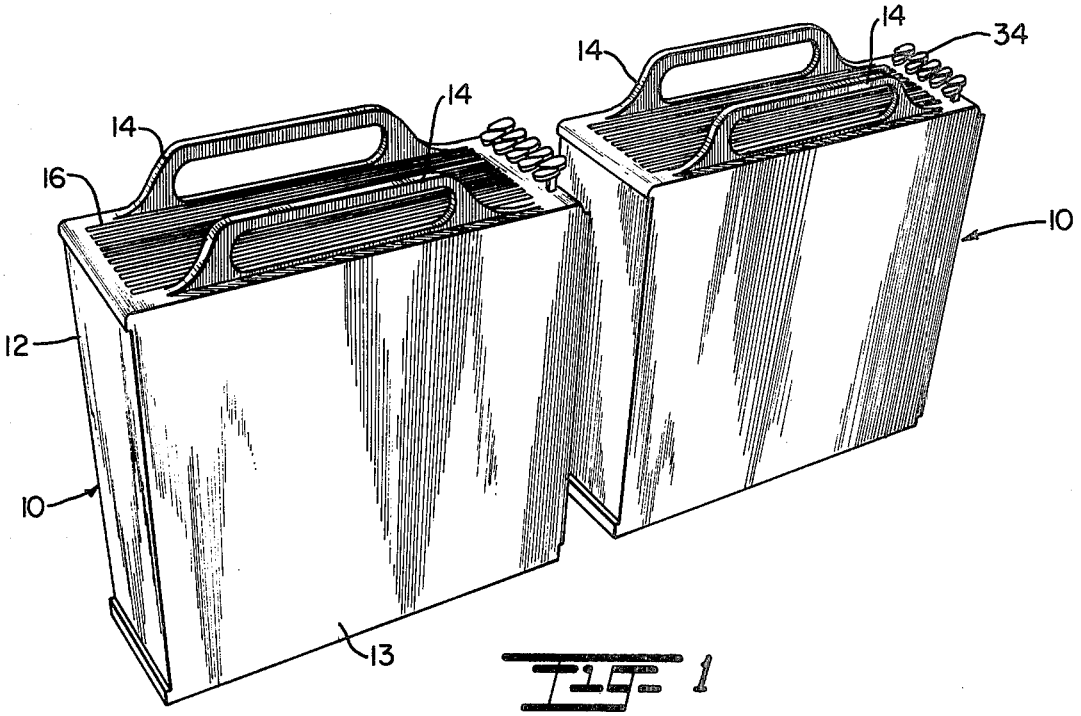
FIG. 1 is a somewhat perspective view illustrating a pair of modular container units, in accordance with the present invention.

Referring in detail to the drawings, there is illustrated in FIGS. 1 to 7 a pair of generally rectangular, modular storage containers 10 disposed in end-to-end relation to one another. Each storage container has outside storage modules defined by opposite sidewalls 12 and 13 adapted to support handle portions 14 as shown. A plurality of intermediate storage modules 16 are nested together between opposite sidewalls 12 and 13, each storage module 16 defining a storage cell into which a disk or diskette which is represented at D may be placed. It is to be understood that any number of storage modules 16 may be sandwiched or nested together between opposite sidewalls 12 and 13 in the assembly of a storage container unit having the desired number of storage locations for the disks. Further, several storage containers 10 may be placed together in a column or row with the sidewalls 12 and 13 of adjacent units 10 in abutting relation to one another in forming a complete floppy disk storage system.

Figure 3:
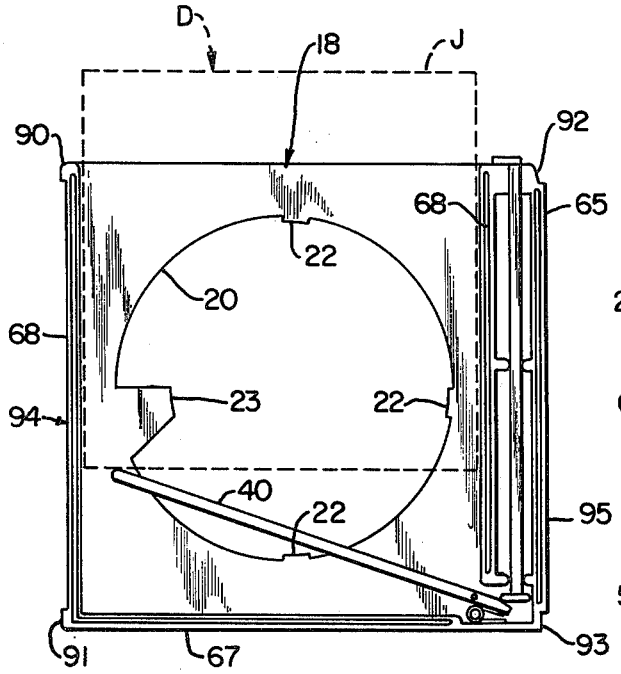
FIG. 3 is a view similar to FIG. 2 illustrating the operation of the ejector mechanism when depressed to advance a floppy diskette from the container unit.
Figure 2:
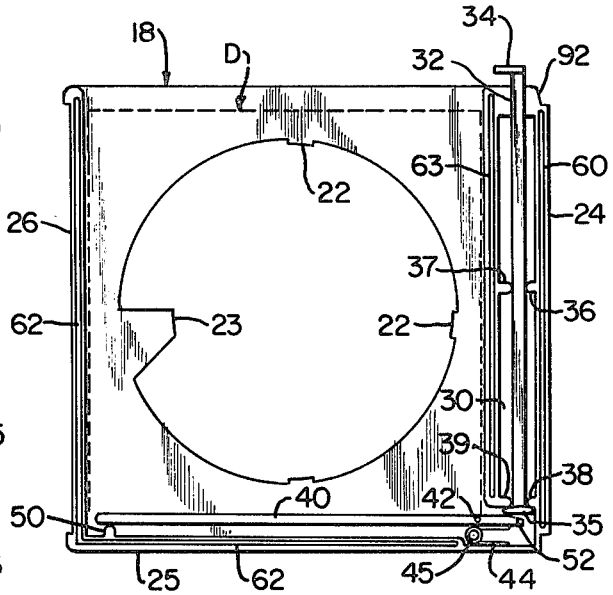
FIG. 2 is an elevational view of one of the storage modules illustrating the disposition of the spring-loaded ejector mechanism one one surface of the storage module.
Figure 4:
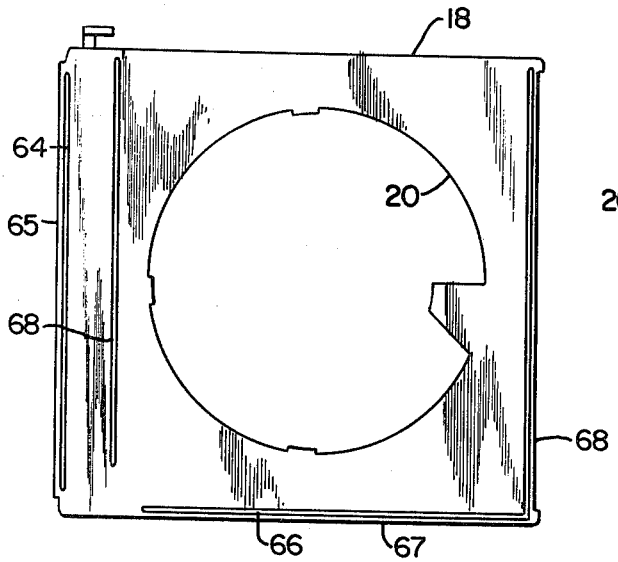
FIG. 4 is an elevational view illustrating the opposite surface or side of the storage module to that shown in FIGS. 2 and 3.

Considering in more detail the construction of the individual storage modules 16, as shown in FIGS. 2 to 4, each storage module has a thin, flat rectangular panel 18 provided with a generally circular cut-out portion 20 for the purpose of weight reduction. The cut-out portion is interrupted by three relatively narrow projections 22 and a relatively wide projection or ramp 23, the projections 22 and 23 extending radially into the cut-out area in the plane of the panel and are formed as a part of each panel 18. The ribbed surface of a panel is shown in FIGS. 2 and 3 wherein the outer perimeter is provided with raised, narrow elongated rims along three edges of the panel and enumerated as 24, 25 and 26, said rims traversing the length of each edge of a panel and protruding away from the flat surface of the panel. Further a rib 28 protrudes from the same surface of the panel 18, the rib 28 extending in inner spaced parallel relation to and substantially coextensive with the rib 24 so as to form a channel 30 for the movement of a push rod 32 as hereinafter described. Preferably the rib 28 is of substantially the same thickness as the rims or ridges 24, 25 and 26, this thickness being greater than the thickness of a disk to be stored in the compartment formed by the module in a manner to be described.

A spring-loaded ejector or retrieval mechanism for each compartment comprises the push rod 32 which is constrained for linear movement in channel 30 between and parallel to the rim 24 and rib 28. The push rod 32 terminates at one end in a selector tab 34 and at the opposite end in a generally T-shaped bar or foot 35. The push rod 32 is guided in its movement by a series of guides or nubs including a nub 36 which is formed as an inward transverse projection of the rim 24 and a guide or nub 37 formed as a projection of the rib 28 and being aligned opposite to the nub 36. At the opposite end, the push rod 32 is guided by a nub 38 formed as an inward transverse projection of the rim 24 and a second nub 39 aligned opposite to the nub 38 and formed as a transverse projection of the rib 28. It will be noted that the nubs 36 to 39 project into the channel 30 to serve as guides or spacers for the lengthwise movement of the push rod in a plane parallel to the plane of the channel.

A second element of the retrieval mechanism consists of a narrow elongated lever 40 which is provided with a bore near one end thereof to receive a pivot or post 42 which projects from the panel 18 to guide pivotal movement of the lever about the post. A third element of the ejector mechanism comprises a clutch spring 44 which is coiled about the post 45 so that a free end of the spring 44 rests against the rim 25 and the other free end of the spring rests against the lever 40. The post 45 similarly to the post 42 projects upwardly from the one surface of the panel 18.

The rim 25 also includes a nub 50 which defines a limit or stop against which the lever 40 is normally urged by the spring 44 so that in its normal state the lever is substantially parallel with the rim 25. The nubs 38 and 39 also act as constraining guides for the lever and prevent movement of foot 35 out of the guide channel defined by rim 24, rib 28 and nubs 36–39, and one end 52 of the lever may be chamfered or beveled away from the nub 39 so that a generally V-shaped space is formed between the nub 39 and the end 52. An arm 54 of the T-shaped foot of the push rod 32 extends into the space formed so as to bear against the pivotal end of the lever 40.

In accord with the conventional practice, a storage diskette D is normally contained in a protective jacket represented at J which is suitably composed of a plastic outer cover and liner. The liner material prevents both damage to the diskette and data loss by imparting a cleaning action that eliminates static charges at the same time. The diskette D is represented in FIG. 2 in dotted configuration so that the elements of the storage module may be more fully appreciated. FIG. 3 illustrates the operation of ejector mechanism in removing a storage disk D contained in a jacket. Specifically, in order to remove the diskette D from its storage cell, the tab 34 is depressed so as to cause the push rod 32 to move against the end of the lever 40 as shown in FIGS. 2 and 3. The push rod 32 is constrained for linear movement by the nubs 36, 39 as described so as to cause the generally T-shaped bar or foot of the arm 32 to interact with the end of the lever 40 whereby the lever 40 is caused to pivot about the post 42 against the bias of spring member 44. The movement of the one pivotal end of the lever will cause the opposite free end of the lever to rock forward through the storage module 18 and to bear against one edge of the diskette in forcing it through the storage cell. Thus the diskette which normally abuts the lever 40 when inserted into the storage cell is advanced from a storage position within the module to a position projecting at least partially out of the storage module so as to permit its complete removal from the module. Upon releasing the tab 34, the spring member 44 urges the lever 40 and push rod 32 back to their normal positions as shown in FIG. 2. The purpose of the projection 23 will now be better appreciated as it serves to prevent the free end of the lever 40 from being misaligned or jammed against the inner edge of the circular cut-out portion 20.

In order to sandwich or nest a plurality of storage modules 18 together in forming a common storage container unit 10 as shown in FIG. 1, it is necessary to provide some positioning and attachment means on each of the storage modules 16. To this end, mating slots and ridges are provided on opposite surfaces of each storage module as may be seen from FIGS. 2 and 3. Specifically, in FIGS. 2 and 3 there is illustrated a ridge 60 which is raised or stepped from rim 24 and extends substantially the length of the rim 24. A second ridge 62 projects from the rims 25 and 26 and extends substantially the length of each of the rims 25 and 26. As illustrated in FIGS. 2 and 3, the ridge 62 is formed continuously as a right angle member along the rims 25 and 26. A third ridge 63 projects from the surface of rib 28 and extends substantially the length of that rib.

FIG. 4 illustrates the reverse surface of a panel 18 wherein a plurality of slots are formed to mate with the ridges 60, 62 and 63. Specifically, a slot 64 is disposed parallel and adjacent to an edge 65 and is adapted to mate with ridge 60 on the opposite surface of an adjacent module when two such modules are nested or sandwiched together. Similarly, a right angle slot 66 is formed adjacent and parallel to edges 67 and 68 and is adapted to mate with the ridge 62. As shown in FIG. 4, the slots 66 form a right angle in a similar manner to the ridge 62 so that it may mate with the ridge 62 on the opposite surface of the adjacent module when nested together. Finally a slot 68 is formed in the surface of the panel in spaced, substantially parallel relation to the slot 64. It is important to note that the slot 68 is positioned opposite to the ridge 63 so that the slot 68 will mate with the ridge 63 on an adjacent module when a pair of modules are nested together. In the foregoing manner, when two storage modules are nested together, the slots as described on the surface of one storage module will mate with the ridges on the opposite surface of an adjacent storage module. In order to permanently fasten or secure the modules together, a suitable adhesive or bonding agent may be placed between or along the mating surfaces.

Figure 5:
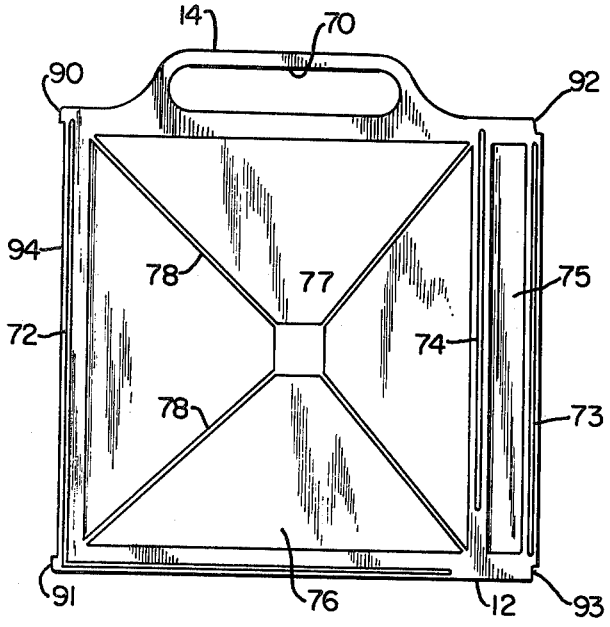
FIG. 5 is an elevational view of one of the outside modules or outermost panels of the container unit.
Figure 6:
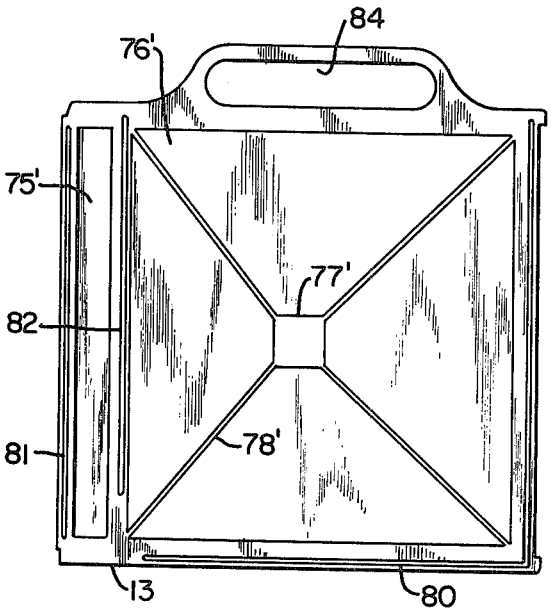
FIG. 6 is an elevational view of the opposite outside panel of the container unit.

As mentioned, a plurality of panels 18 may be sandwiched or nested to form a common storage container unit 10 as shown in FIG. 1. Once the desired number of panels 18 are secured to one another in the manner described above, opposite end panels or covers 12 and 13 may be placed on the assembled modules. The modular end panels 12 and 13 are provided with handle units 14 which as more specifically shown in FIGS. 5 and 6 are formed as unitary extensions in the planes of their respective modular panels, each handle having an elongated slot or opening 70 to facilitate grasping in the hand. In the preferred form, the handle unit for one panel 12 is adapted to be secured to the one surface of a storage module 18 having exposed slots 64, 66 and 68. Similarly, the opposite module 13 is of a configuration to mate with the ribbed surface of a storage unit having the exposed ridges 60, 62 and 63.

The end modules are most desirably formed as left-hand and right-hand modules 12 and 13, as illustrated in FIGS. 5 and 6, respectively, the left-hand module being provided with ridges on its interior surface so as to be complementary to a grooved or slotted surface of one of the inner or intermediate modules 18, and the right-hand module 13 as shown in FIG. 6 is slotted so as to be complementary to the opposite ribbed surface of an interior module 18. Referring to FIG. 5, a first right angle ridge 72 extends continuously along two mutually perpendicular edges of the module, a ridge 73 extends along and parallel to a third edge of the module and a ridge 74 extends in inner spaced parallel relation to the ridge 73. The ridges 73 and 74 flank opposite sides of a narrow elongated recessed portion 75. As opposed to the inner cut-out portion formed in the modules 18 the central portion of the module 12 has a broad shallow recessed portion as shown and designated at 76, the recessed portion provided with a central raised portion 77 of square configuration with radially extending ribs 78 extending from the corners of the square to the outside corners of the square recessed portion 76. This particular construction of the module is intended to reduce the bulk or weight of the module while affording the necessary reinforcing along those sections which carry the ridges 72 to 74 as well as the intermediate reinforcing members 77 and 78. It will be further apparent that the ribs 72 to 74 are so located as to mate with the slots 64, 66 and 68 so as to form the outermost compartment at one side of the container. The outer module 13, as shown in FIG. 6, is similarly formed with interior recessed portions 75′ and 76′ corresponding to the recessed portions 75 and 76 of the left-hand module 12. Similarly, interior reinforcing is provided in the form of a square section 77′ and ribs 78′. However, in place of the ridges 72 to 74, slots are formed in the thicker wall portions of the module including a continuous right angle slot 80 extending along and parallel to two edges of the module, a narrow elongated slot 81 is formed along a third edge of the module and a second narrow elongated slot 82 substantially coextensive with the slot 81 is formed in inner spaced parallel relation to the first slot 81. Again, as stated earlier, the right-hand module is formed such that the slots 80 to 82 will mate with the ridges 60, 62 and 63 of an intermediate module 18.

Preferably, the handle portions 14 on each of the modules 12 and 13 are molded as unitary extensions in the plane of the module from the fourth edge. Preferably, each handle is in the form of a generally oval-shaped member provided with an elongated oval-shaped recessed portion 84 defining a closed loop to facilitate grasping of the handle in the hand. Moreover, it will be noted that the handle formed on each module is offset somewhat from center so as to be located relatively away from the edge of the module containing the push rod member, the push rod of course extending along the channel formed between the slotted portions 73, 74 or the rib portions 81, 82. As the case with the interior modules, the outer modules 12 and 13 may be adhered to the interior modules by application of a suitable bonding agent the mating ridge and slotted surfaces.

Figure 7:
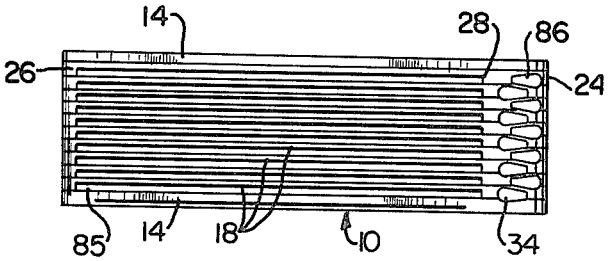
FIG. 7 is a plan view of the assembled modules for a preferred form of container unit in accordance with the present invention.

FIG. 7 illustrates the assembled container unit when viewed from the end or side containing entrances 85 to the slotted compartments formed between each pair of assembled modules. It will be readily apparent that the container may be formed with virtually any desired number of slotted compartments which are sandwiched between the left and right-hand modules 12 and 13 to provide the desired storage capacity for each container unit. FIG. 7 also illustrates the manner in which the tabs 34 are arranged along one edge of the slotted compartment to afford selection of a desired disk. The individual retrieval mechanism for each compartment was described with reference to FIGS. 2 and 3. It is important to note from FIG. 7 however that each tab 34 is of generally elongated configuration extending normal to and diverging away from a push rod with the enlarged end 86 of each tab offset from the push rod. Further in assembled relation as shown in FIG. 7, each tab 34 in succession is oppositely directed so that the enlarged or divergent ends of the tabs are readily accessible for selective, individual actuation; yet the narrow ends of the tabs are spaced closely together. This may be accomplished simply by reversing each push rod 30, as shown in FIG. 2, since either end of the T-shaped bar or foot 35 at the opposite end of the push rod will interact in the same manner with an end of the lever 42. This of course avoids the necessity of manufacturing two different types of push rods. Additionally, as illustrated in FIG. 7, the exposed edges 92 of the panels to be described afford convenient locations for indexing the associated storage cell, which indexing can be accomplished by numbering or otherwise coding the particular storage cell associated with the particular nubs being indexed.

Another feature of the present invention resides in the ability to nest or stack a plurality of storage containers 10. The manner in which this is accomplished may be readily appreciated by referring to FIG. 3 wherein the edge of each module outwardly of the channel portion has outwardly projecting shoulders 90 and 91 at two corners which are complementary to relieved portions 92 and 93 on the opposite edge of a module. The space between the shoulders 90 and 91 forms an inset or recessed area 94 adapted to receive the ribbed portion 95 formed between the relieved corner portions 92 and 93. The outer modules 12 and 13 are provided with corresponding ribs and recessed portions are enumerated so that when assembled together with the interior modules in forming a container unit, that container unit may be nested on top of another container unit whereby the ribs 90 and 91 will overlie and nest with the rib 95 of another unit. Of course as illustrated in FIG. 1 the container units are shown in side-by-side relation with the nestable edges in confronting relation to one another. It will be readily apparent that the container units can be rotated either direction 90° and one stacked upon the other. Most desirably, the container units are positioned so that the recessed edge portion 94 serves as the base and the slotted compartments are arranged to extend vertically with the selector tabs above the compartments. As noted earlier, the handle portions 14 are located in somewhat offcenter relationship so as to be away from the selector tabs and not interfere with selection and removal of the disks. At the same time by forming the handles as unitary extensions in the plane of the outer end modules, it is possible to place the modules in side-by-side relation to one another with the outer end modules disposed flush to one another. Depending upon space requirements, it is equally as apparent that the modules may be placed in virtually any desired orientation and specifically so that any one of the six sides other than the side containing the handles may form the base of the container units. The ejector mechanism will operate in any desired orientation since opposite surfaces of adjacent modules are secured closely enough together to permit space only for the ejector mechanism and a disk in the plane of the ejector mechanism. Thus the ejector mechanism contains the three essential elements within the storage cell which are located in a common plane and which is also a plane in common with that of the disk.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

What is claimed is:

1. In a storage container for a plurality of thin, flat recording disks wherein said storage container is a multi-sided enclosure having slotted compartments in one side thereof, each compartment provided with an entrance adapted to permit insertion of a disk into said compartment and provided with ejector means in each compartment being responsive to depression of a push rod and the like to eject a disk therefrom, the improvement comprising:

a plurality of storage modules interconnected to define a slotted compartment between each adjacent pair of modules, each module comprising a generally rectangular panel having opposite flat surfaces, upstanding ribs on one of said surfaces extending substantially continuously along the perimeter of said rectangular panel except at the entrance and forming spacing members between the surfaces of said rectangular panel and a guide rib in spaced-apart parallel relation to one of said upstanding ribs, said one of said upstanding ribs and said guide rib including nubs thereon and forming a channel for movement of said push rod between said parallel ribs and their associated said nubs in directions parallel to the plane of said modular panel, and grooves on the opposite surface of each module adapted to mate with said ribs in the one surface of an adjacent module to form a slotted compartment between said modules;

selector tab means at the end of each said push rod projecting externally of said container unit and adapted to be depressed to actuate said ejector means to advance a selected disk therefrom; and positioning means on said container adapted for positioning one container with respect to another container, said positioning means including a pair of upstanding shoulders on one side of said container defining a recessed area therebetween and a ribbed portion on the opposite side of said container formed by relieved corner portions of opposite aligned edges of said modules whereby the recessed portion of each container is adapted to nest with the ribbed portion of another container.

2. In a storage container unit according to claim 1, said parallel ribs extending parallel to the direction of movement of said disk through each respective compartment.

3. In a storage container unit according to claim 1, including other modules having handle portions defining unitary extensions of said outer modules in the plane of said modules.

4. In a storage container unit according to claim 3, one outer module having ribs on its internal surface, and another outer module opposite to the one outer module having grooves on its internal surface and a plurality of radial ribs forming a guide for a disk placed in the associated slotted compartment of said outer module.

5. In a storage container unit according to claim 1, selected of said upstanding ribs having upstanding narrow extension ridges adapted to be inserted in the grooves on the opposite surface of an adjacent module, said ejector means including an ejector lever adapted for pivotal movement into the interior of said slotted compartment, and each of said rectangular panels having an enlarged, generally circular cut-out portion located centrally thereof and including a flat projection projecting radially into said cut-out portion in the plane of its respective rectangular panel, said flat projection operative to guide the pivotal movement of said ejector lever.

6. In a storage container unit according to claim 1, said selector tab means being defined by a thumb button of flat elongated configuration extending at a right angle to an associated push rod, each said tab means diverging transversely away from connection to an associated push rod.

7. In a storage container unit according to claim 6, successive tabs extending in opposite directions away from said push rods in a position along one edge of the entrance to said slotted compartments.

8. In a storage container unit according to claim 7, further including indexing means extending along the external surface of one side of said container unit adjacent to the edges of said slotted compartments adapted to identify the information contained on the disks therein.

9. In a storage container unit according to claim 1, said slotted compartments formed to extend from one side of said container unit, and said container unit adapted to rest on the other sides thereof, said outer modules defining opposite sides of said slotted compartments, and said handle units extending from said outer modules on opposite sides of the entrances to said slotted compartments.

10. A portable modular container unit adapted for the storage of floppy disks therein comprising in combination:

a plurality of flat rectangular panels each having a flat surface on one side provided with elongated slots along three peripheral edges and a ribbed surface on the opposite side including rib members extending along three peripheral edges, upstanding locating ridges on said rib members adapted for insertion in said slots on the flat surface of an adjacent module whereby a slotted compartment is formed between adjacent modules, the width of each compartment being determined by the thickness of said rib members on said panel, a plurality of said panels being interconnected to define a corresponding plurality of slotted compartments arranged in closely spaced parallel relation to one another;

disk ejector means in each of said slotted compartments including manually depressable selector tab members projecting externally from one edge of each slotted compartment; and complementary rib and recess portions on opposite sides of each container unit, said rib portion being nestable in a recessed portion of an adjacent unit.

11. A portable modular container unit according to claim 10, including outer panels on opposite sides of said container unit disposed perpendicular to said complementary rib and recessed portions, said outer panels having handle portions extending in the plane of said outer panels in parallel with the slotted compartments.

12. A portable modular container unit according to claim 10, each selector tab member in succession extending in a direction opposite to each next adjacent tab member, and each tab member diverging into a relatively wide surface at a free end thereof.

13. In a storage container for a plurality of thin, flat recording disks wherein said storage container is a multi-sided enclosure having a plurality of compartments, each compartment provided with an entrance on a side of said container and adapted to receive a disk therein, each compartment having ejector means responsive to depression of a push rod and the like to eject a disk from its respective compartment, the improvement comprising:

a pair of parallel ribs in each compartment oriented at substantially right angles to said entrance and operative to space each compartment from an adjacent compartment, said ribs defining a guide path for said push rod;

said push rod being elongated and terminating at a first end in a flat foot and at the second end in a T-shaped crossbar, said second end being mounted in the interior of said compartment;

said ejector means including an elongated lever positioned in perpendicular relation to said push rod and pivotally mounted at a point near a first end to its associated said compartment and adapted for pivotal movement into the interior thereof, said first end positioned adjacent said crossbar and having an angled surface portion facing said crossbar with one arm of said crossbar adapted for abutting said angled surface portion for sliding movement therealong when said lever is pivoted into said compartment; and a nub associated with one of said parallel ribs defining stop means at an end of said guide path adjacent said crossbar for preventing movement of said crossbar into said guide path and withdrawal of said push rod from said compartment.

14. In a storage container according to claim 13 further including complementary rib and recessed portions on opposite sides of each container unit, said complementary rib portion being nestable in a complementary recessed portion of an adjacent container unit.

* * * * *

UNITED STATES PATENT AND TRADEMARK OFFICE

CERTIFICATE OF CORRECTION

PATENT NO. : 4,202,585

DATED : May 13, 1980

INVENTOR(S) : Cary R. Lawler

It is certified that error appears in the above—identified patent and that said Letters Patent is hereby corrected as shown below:

IN THE SPECIFICATION:

Column 4, line 20, cancel "40" and substitute -- 42 --.

Column 7, line 33, cancel "are" and substitute -- as --.

IN THE CLAIMS:

Claim 3, Column 8, line 56, cancel "other" and substitute -- outer --.

Signed and Sealed this

*Nineteenth* Day of *August 1980*

[SEAL]

*Attest:*

SIDNEY A. DIAMOND

*Attesting Officer*

*Commissioner of Patents and Trademarks*